US005318306A

United States Patent [19]

Levin

[11] Patent Number: 5,318,306

[45] Date of Patent: Jun. 7, 1994

[54] EDUCATIONAL GAME

[76] Inventor: John M. Levin, 412 Fairview Rd., Narberth, Pa. 19072

[21] Appl. No.: 987,528

[22] Filed: Dec. 4, 1992

[51] Int. Cl.[5] ..... A63F 1/00

[52] U.S. Cl. ..... 273/293; 273/308; 273/292

[58] Field of Search ..... 273/293, 292, 295, 308, 273/300–302, 260, 290, 261; 40/156, 159, 124.2, 124, 124.1

[56] References Cited

U.S. PATENT DOCUMENTS

| | | | |
|---|---|---|---|
| 2,946,592 | 7/1960 | Post | 273/290 |
| 3,608,904 | 9/1971 | Margetson | 273/260 |
| 4,856,789 | 8/1989 | Carlson | 273/261 |
| 5,201,525 | 4/1993 | Castro | 273/293 |

OTHER PUBLICATIONS

Civil War Chess Set, Games Magazine pp. 16–17, Jan. 1986.

*Primary Examiner*—Benjamin H. Layno

*Attorney, Agent, or Firm*—Caesar, Rivise, Bernstein, Cohen & Pokotilow, Ltd.

[57] ABSTRACT

A game including multiple playing pieces; with the multiple playing pieces including a plurality of identical sets of playing pieces. Each identical set of playing pieces includes a plurality of playing pieces having non-numerical indicia representing inanimate or animate objects which are rankable in a specific order relative to each other; each of the plurality of playing pieces including indicia representing one of the objects. Each of the plurality of playing pieces includes retaining means for retaining additional indicia that indicates a specific condition of the object represented on that respective playing piece, with the specific condition having a bearing on the order of ranking of the object.

24 Claims, 2 Drawing Sheets

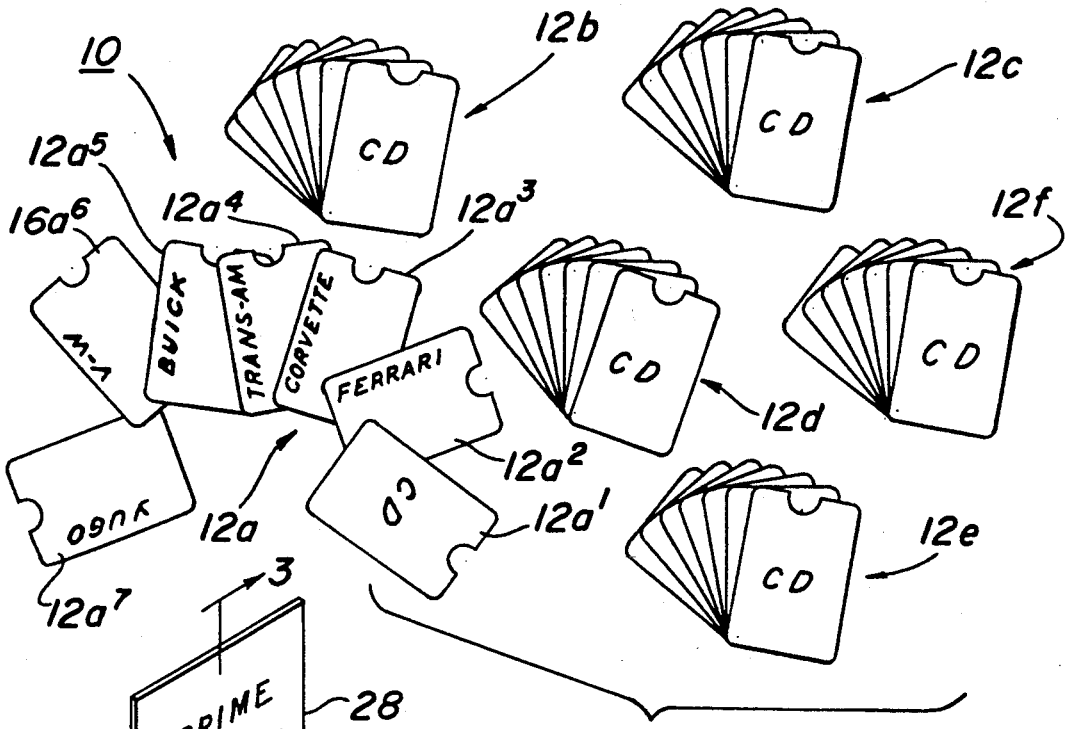
FIG. 1
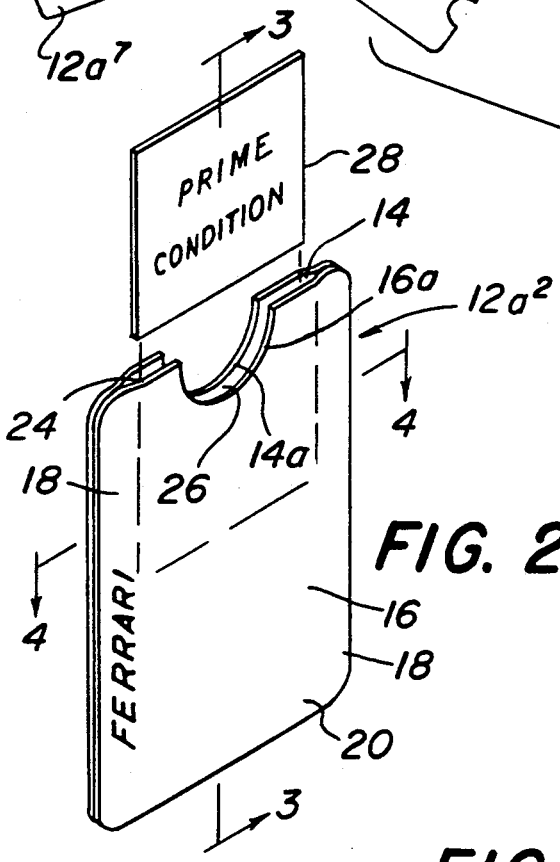
FIG. 2
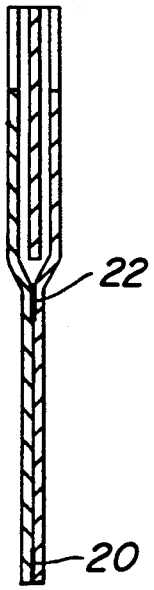
FIG. 3
FIG. 4
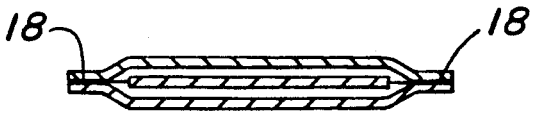

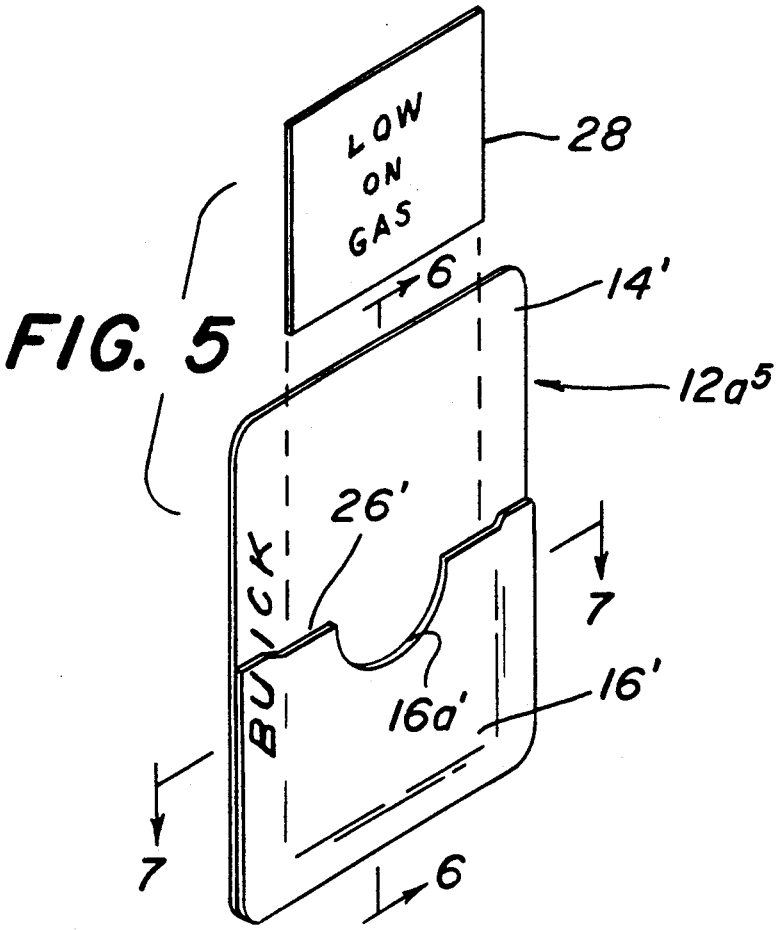
FIG. 5
FIG. 6
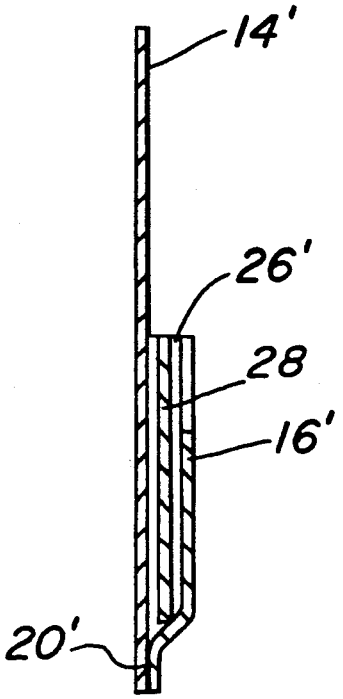
FIG. 7
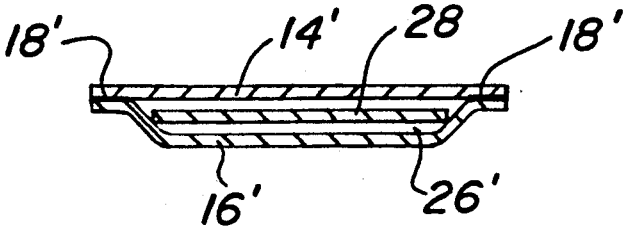

EDUCATIONAL GAME

BACKGROUND OF THE INVENTION

This invention relates generally to games, and more specifically to an educational game which teaches and reinforces information regarding a variety of objects; both animate and inanimate, and which is readily adaptable to be played as a "card" game.

Card games are extremely popular with both adults and children. Many of the games are extremely convenient to play, because they do not involve the use of other objects, such as dials, dice, boards, etc.

One card game which has been popular for years, is the game of "war". In that game a conventional, 52-card deck of playing cards is dealt, with the cards face down, to two or more players. After all of the cards have been dealt, each player turns his or her top card over, exposing the "value" of the card. The player having the highest card value wins the other players' cards.

If two or more players expose cards having the same value, a "war" is declared between (among) those players. To determine the winner of the war, each of the players participating in the war places one or more cards (most commonly two cards) face down, and then an additional card face up. The participating player with the highest additional face-up card wins the war, and if that card also is higher than the face-up cards of the other players, then he or she wins all of the other players' cards in that particular round. If the additional face-up card of a participant in the war either is the same value as the additional face-up card of another participant(s) in the war, or is the same value as one of the other players, then a second war exists. This second war, and any subsequent wars, are "fought" in the same way as described above with respect to the first war. Play proceeds until one player has one all of the playing cards from the other players.

The game of war has achieved such a high degree of popularity that patterning educational games in a format similar to "war" is an effective way of providing an educational experience for the players; both children and adults. It is to such a game that the present invention relates.

OBJECTS OF THE INVENTION

It is a general object of this invention to provide an educational game which provides and reinforces information relating to animate or inanimate objects in an easy-to-play, enjoyable format.

It is a further object of this invention to provide an educational game which is entertaining, and yet which provides a learning experience about animate and/or inanimate objects.

It is still a further object of this invention to provide an educational game which is played in a manner similar to the highly popular card game of war.

SUMMARY OF THE INVENTION

The above and other objects of this invention are achieved by providing a game including multiple playing pieces; said multiple playing pieces including a plurality of identical sets of playing pieces. Each identical set of playing pieces includes a plurality of playing pieces having non-numerical indicia representing inanimate or animate objects which are rankable in a specific order relative to each other; each of said plurality of playing pieces including indicia representing one of said objects. Each of the plurality of playing pieces includes retaining means for retaining additional indicia that indicates a specific condition of the object represented on said respective playing piece, with each condition having a bearing on the ranking of the object.

In a preferred embodiment of the invention the order of ranking the objects represented on the plurality of playing pieces in each set is on the basis of a common attribute, e.g., strength, speed, etc.

In the preferred embodiment the additional indicia represents a condition affecting the common attribute of the objects, to thereby have a bearing on the order of ranking of each of said objects.

In the preferred embodiment of the invention playing pieces are provided which have a ranking higher than the ranking of any of the animate or inanimate objects, and thereby function as "wild cards".

In the preferred embodiment of the invention the game includes at least four sets of playing pieces, and more preferably six sets of playing pieces.

In the preferred embodiment of this invention each of the playing pieces is a card-shaped piece including a compartment for receiving an additional member having additional indicia that represents a condition affecting the common attribute of the objects presented on the playing pieces, said additional member being removably receivable within said compartment, said additional indicia being concealed from view when said additional member is within said compartment.

In preferred embodiments of the invention the animate and inanimate objects depicted on the playing pieces can be automobiles, fish, animals, dinosaurs, fictional characters and apes.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is an expanded plan view of the multiple pieces employed in the preferred embodiment of the game constructed in accordance with this invention;

FIG. 2 is an enlarged, exploded isometric view of one of the playing pieces illustrated in FIG. 1 and showing an insert member employed as a part thereof;

FIG. 3 is a sectional view taken along line 3—3 of FIG. 2;

FIG. 4 is a sectional view taken along line 4—4 of FIG. 2;

FIG. 5 is an exploded isometric view of an alternative form of playing piece utilized in the game of this invention; showing an insert member that also is employed with the playing piece illustrated in FIG. 1;

FIG. 6 is a sectional view taken along line 6—6 of FIG. 5, with the insert member within its receiving pocket; and FIG. 7 is a sectional view taken along line 7—7 of FIG. 5, with the insert member within its receiving pocket.

DESCRIPTION OF THE PREFERRED EMBODIMENTS OF THE INVENTION

Referring now in greater detail to the various figures of the drawings wherein like reference characters refer to like parts, an educational game embodying the present invention is generally shown at 10 in FIG. 1. The game 10 basically comprises a plurality of identical sets of playing pieces; six such sets being shown at 12*a*, 12*b*, 12*c*, 12*d*, 12*e* and 12*f*. In the preferred embodiment the game 10 includes at least four identical sets, and most preferably six identical sets. However, it is within the scope of the present invention to utilize a different number of identical sets in the game.

Each of the sets of playing pieces are identical, and therefore the description of one complete set will follow, it being understood that the remaining sets are the same.

The set 12*a* of playing pieces is in the form of seven card-like members $12a^1$, $12a^2$, $12a^3$, $12a^4$, $12a^5$, $12a^6$ and $12a^7$; six of which ($12a^2$–$12a^7$) include non-numeric indicia representing inanimate or animate objects which are rankable in a specific order relative to each other.

In the illustrated embodiment the non-numeric indicia represents automobiles, and actually can include both the name and graphic or pictorial representation of the automobiles. As shown, the six automobiles identified in each set (e.g., 12*a*) of playing pieces, and ranked on the basis of decreasing speed, are a Ferrari, a Corvette, a Pontiac Trans-Am, a Buick, a V-W and a Yugo. Although only the names are shown on the various playing pieces, it should be understood that a picture or other graphic representation of each identified automobile also can be included on the playing pieces.

The seventh playing piece $12a^1$ in each set of playing pieces is a "wild card", having the highest ranking in the set. In the illustrated embodiment this latter card bears the initials "C D", for Charles Darwin. It is understood that Charles Darwin's complete name and likeness can be included on the playing pieces $12a^1$, or alternatively, another designation can be used to identify the wild card. In the embodiment of the invention in which the "Charles Darwin" card is the wild card, applicant identifies the game as "Survival of the Fittest."

Each of the playing pieces of the game 10 are of an identical construction. Therefore, that construction will be described with respect to only one playing piece, i.e., $12a^2$.

Referring to FIGS. 2–4, the playing piece $12a^2$ is in the form of a card-like member; preferably having dimensions approximating the dimensions of a playing card in a conventional 52-card deck of such cards. As can be seen in FIGS. 2–4, the playing piece $12a^2$ is a laminate including two substrates 14 and 16 bonded together along peripheral side edges 18, peripheral bottom edge 20 and along a horizontal zone 22 intermediate the bottom edge 20 and the top margin 24. The bonded regions between the two substrates 14 and 16 provide a pocket 26 for retaining an additional member 28 therein, and the upper edge of each of the substrates 14 and 16 is provided with a recess 14*a*, 16*a*, respectively to provide open areas at which the fingers of the players can easily grip the additional member 28, to permit the additional member 28 to be easily inserted in and removed from the pocket 26 of the playing piece.

The additional member 28 contains additional indicia having a bearing on the ranking of the object depicted on the playing piece. As illustrated the additional indicia on the additional member 28 either specifies that the automobile is in "PRIME CONDITION" (FIG. 2), or is "LOW ON GAS" (FIG. 5). It should be understood that any of the automobiles in each set that is in "PRIME CONDITION" will have a higher ranking than any other automobile in the set that is "LOW ON GAS", e.g., a Yugo in "PRIME CONDITION" has a higher ranking than a Ferrari that is "LOW ON GAS".

FIGS. 5–7 show an alternative form of playing piece $12a_5$ usable in the present invention. This playing piece is similar to the playing piece shown in FIGS. 2–4; having a pair of substrates 14', 16' bonded together to form a pocket 26' to receive on of the additional members 28. However, in this embodiment the substrate 16' is approximately one-half the height of the substrate 14', and only the upper margin of the substrate 16' is provided with a recess 16*a'* to provide easy access to the additional member 28 to be inserted and/or removed from the pocket 26'. Also, in this embodiment the pocket 26' is provided by bonding the substrates 14*a'* and 16*a'* together only along the peripheral sided edges 18' and the peripheral bottom edge 20', as can be seen best in FIGS. 7 and 8.

In should be understood that the particular form and composition of the playing pieces is not a limitation on the broadest aspects of the invention. If desired the shape of the playing pieces can be other than rectangular, and can be made from a variety of materials, such as, paperboard, plastic, thin metal, etc. However, in the preferred embodiment of the invention the playing pieces are generally rectangular, having a width and height approximately the same as conventional playing cards. Most preferably the substrates 14, 16 and 14', 16' are made from a paperboard stock, similar to that employed in the manufacture of conventional playing cards.

It also should be understood that although the two additional members 28 are shown in association with the different forms of playing pieces $12a^2$ and $12a_5$, respectively, it should be understood that both forms of the additional member 28 are used with the educational game, regardless of the shape, size and/or composition of the playing pieces.

In the preferred form of this invention the game 10 includes six sets of playing pieces, with each set consisting of 7 playing pieces. Thus, there are six (6) playing pieces for each of the automobiles, and six (6) wild cards, e.g., CHARLES DARWIN cards.

For reasons which will become apparent when the play of the game is described, the additional member 28 specifying "PRIME CONDITION" is in the pockets of 4 of the Ferrari and Corvette playing pieces, and the additional member 28 specifying "LOW ON GAS" is in the pockets of 2 of the Ferrari and Corvette playing pieces.

The additional member 28 specifying "PRIME CONDITION" is in the pockets of 3 of the Pontiac Trans-Am and Buick playing pieces, and the additional member 28 specifying "LOW ON GAS" is in the pockets of the remaining 3 of the Pontiac Trans-Am and Buick playing pieces.

The additional member 28 specifying "PRIME CONDITION" is in the pockets of 2 of the V-W and Yugo playing pieces, and the additional member 28 specifying "LOW ON GAS" is in the pockets of the remaining 4 of the V-W and Yugo playing pieces.

As is shown in FIG. 1, in the preferred embodiment of this invention the educational game 10 includes 42 playing pieces (six sets; each having seven playing pieces). Most preferably the game is played by either two or three people.

The game is played by dealing all of the playing pieces face down to the players. When two people are playing the game each player receives 21 playing pieces, and when three people are playing the game each player receives 14 playing pieces.

The game 10 is played much like the conventional card game of war, with the addition of some interesting statistical implications not encountered in the convention game of war.

The game proceeds with each player turning one of his playing pieces face up, to expose the automobile specified on the playing piece. The player having the highest ranking playing piece, i.e., the one depicting the fastest automobile, wins the round, unless the party with a lower ranking playing piece "challenges". Of course the wild card is the highest card, and always wins.

If a party with a lower ranking card challenges the other player(s), each player is required to place two additional cards face down, which will be won by the winner of the round, after the challenge. After the two additional cards are placed face down, each of the players removes the additional member 28 from his or her face up card, to determine whether the additional member specifies "PRIME CONDITION" or "LOW ON GAS". As stated earlier, any automobile which is in "PRIME CONDITION" is of a higher ranking than the same or any other automobile which is "LOW ON GAS". Therefore a Yugo in "PRIME CONDITION" is of a higher ranking than a Ferrari that is "LOW ON GAS".

Of course, the odds of winning the challenge are always against the challenger, do to the distribution of additional members 28 in the various playing pieces, as described earlier in this application. For example, if a player turning up a Yugo challenges a player turning up a Ferrari the odds are that the Ferrari will come out victorious, since 4 of the 6 Ferrari playing pieces include an additional member 28 specifying "PRIME CONDITION", and only 2 of the 6 Ferrari playing pieces include an additional playing member 28 specifying "LOW ON GAS"; whereas only 2 of the 6 Yugo playing pieces include an additional playing member 28 specifying "PRIME CONDITION", whereas 4 o the 6 Yugo playing pieces include an additional playing member 28 specifying "LOW ON GAS". Thus the odds are definitely against a challenger with the Yugo playing piece having an additional member 28 stating "PRIME CONDITION" at the same time that the additional member 28 in the Ferrari playing piece states "LOW ON GAS". However, it is only when this latter combination of events occur that the player with the Yugo playing piece will be successful in the challenge.

Even when a player with a Corvette playing piece challenges a player with a Ferrari playing piece, the odds are against the challenger. In that case the odds are the same for each player to have an additional member 28 stating either "PRIME CONDITION" or "LOW ON GAS". However, the challenger will only win if the additional member 28 in the Ferrari playing piece states "LOW ON GAS" at the same time that the additional member 28 in his or her Corvette playing piece states "PRIME CONDITION". If the additional member 28 in both the Corvette and Ferarri playing pieces state "LOW ON GAS" or "PRIME CONDITION", then the player with the Ferrari playing piece wins the round.

It should be apparent from the above explanation that statistically the odds are in favor of the non-challenger, even when the challenge is between players having a Ferrari playing piece and a Corvette playing piece, between players having a Pontiac Trans-Am playing piece and a Buick playing piece, or between players having a V-W playing piece and a Yugo playing piece.

In the event that each player turns up a card of the same ranking, e.g., a Ferrari playing piece, then a war is declared. Such a war is resolved in much the same way is in the conventional card game of war, as described earlier in this application. Specifically, each player in the war turns one or two playing pieces face down (preferably two playing pieces), and then an additional playing piece face up. The additional playing piece with the highest ranking wins the war, unless the losing party challenges the winner and is successful in the challenge.

If the losing party in the war challenges the winner, each party to the war places two additional cards down, which will be lost to the winner of the war. Each party then exposes the additional member 28 disposed in the pocket of his or her additional face up card (i.e., the face up card that determined the winner of the war, prior to the challenge). As explained, earlier, the odds are always against the challenger. However, in those situations in which the additional member 28 in the lower ranking playing piece states "PRIME CONDITION" and the additional member 28 in the higher ranking playing piece states "LOW ON GAS". The challenger is the winner.

If the additional face up cards in the war are the same, e.g., both Buick's, then the tie can be broken in a number of ways. For example, as a first tie breaker, the additional members 28 in each of the additional face up cards can be exposed, to determine if the identifying indicia thereon breaks the tie, i.e., by one additional member specifying "PRIME CONDITION" and the other additional member specifying "LOW ON GAS". If the tie is not broken, then the relative ranking of one of the face down cards involved in the war can be used as a second tie breaker. If that doesn't break the tie, then the additional member 28 located in the pocket of the face down cards that were turned up to establish the second tie breaker, can be used as a third tie breaker. If that doesn't break the tie then the second face down card involved in the war (if there were two such face down cards) can be utilized as a fourth tie breaker. If that doesn't break the tie, then the additional member in each of the second face down cards involved in the war can be employed as a fifth tie breaker.

It is highly unlikely that a tie will exist, with five separate tie breakers being available. However, if, by some chance, the five tie breakers do not break the tie, the war can be considered a draw, with each person retrieving his or her cards. Alternatively, some other procedure can be employed to break the tie, such as by the flip of a coin.

The game is won by the player that captures all of his or her opponents playing pieces.

It should be understood that the rules accompanying the game will explain the rank order of the animate or inanimate objects identified on the playing pieces, and also the procedures for playing the games. Although the embodiment illustrated herein includes automobiles which are ranked on the basis of speed, a variety of other objects, either animate or inanimate, can be included in the playing pieces, to provide a number of variations of the educational game 10.

The objects depicted on the playing pieces can be apes, which are ranked by strength. For example the following six apes, ranked from the strongest to the weakest, can be depicted: King Kong, Son of Kong, Might Joe Young, African White Gorilla, Mountain Gorilla and Bonzo. In this version the additional member 28 either will specify "BABY" or "ADULT", with the lowest ranking adult ape (i.e., Bonzo) being stronger than the highest ranking baby ape (i.e., King Kong). Again the instructions to the game will identify the relative ranking of the apes and the manner in which the additional member 28 affects that ranking.

The objects depicted on the playing pieces can be USA predators which are ranked by strength. For example the following six predators, ranked from the strongest to the weakest, can be depicted: Grizzly Bear, Cougar, Wolf, Coyote, Wolverine and Fox. In this version the additional member 28 either will specify "BABY" or "ADULT", with the lowest ranking adult predator (i.e., Fox) being stronger than the highest ranking baby predator (i.e., Grizzly Bear). Again the instructions to the game will identify the relative ranking of the predators and the manner in which the additional member 28 affects that ranking.

The objects depicted on the playing pieces can be fresh water fish, which are ranked by strength. For example the following six fresh water fish, ranked from the strongest to the weakest, can be depicted: Musky, Pike, Bass, Catfish, Sunfish and Minnow. In this version the additional member 28 either will specify "BABY" or "ADULT", with the lowest ranking adult fresh water fish (i.e., minnow) being stronger than the highest ranking baby fresh water fish (i.e., musky). Again the instructions to the game will identify the relative ranking of the fish and the manner in which the additional member 28 affects that ranking.

The objects depicted on the playing pieces can be birds, which are ranked by strength. For example the following six birds, ranked from the strongest to the weakest, can be depicted: Eagle, Owl, Hawk, Crow, Bluebird and Hummingbird. In this version the additional member 28 either will specify "BABY" or "ADULT", with the lowest ranking adult bird (i.e., hummingbird) being stronger than the highest ranking baby bird (i.e., eagle). Again the instructions to the game will identify the relative ranking of the birds and the manner in which the additional member 28 affects that ranking.

The objects depicted on the playing pieces can be salt water fish, which are ranked by strength. For example the following six salt water fish, ranked from the strongest to the weakest, can be depicted: Shark, Marlin, Tuna, Barracuda, Bluefish and Snapper. In this version the additional member 28 either will specify "BABY" or "ADULT", with the lowest ranking adult salt water fish (i.e., snapper) being stronger than the highest ranking baby salt water fish (i.e., shark). Again the instructions to the game will identify the relative ranking of the salt water fish and the manner in which the additional member 28 affects that ranking.

The objects depicted on the playing pieces can be dinosaurs, which are ranked by strength. For example the following six dinosaurs, ranked from the strongest to the weakest, can be depicted: Tyrannosaurus Rex, Brontosaurus, Triceratops, Stegasaurus, Wooly Mammoth and Saber Tooth Tiger. In this version the additional member 28 either will specify "BABY" or "ADULT", with the lowest ranking adult dinosaur (i.e., saber tooth tiger) being stronger than the highest ranking baby dinosaur (i.e., Tyrannosaurus Rex). Again the instructions to the game will identify the relative ranking of the dinosaurs and the manner in which the additional member 28 affects that ranking.

The objects depicted on the playing pieces can be jungle creatures, which are ranked by strength. For example the following six jungle creatures, ranked from the strongest to the weakest, can be depicted: Lion, Leopard, Hyena, Jackal, Snake and Lizard. In this version the additional member 28 either will specify "BABY" or "ADULT", with the lowest ranking adult jungle creature (i.e., lizard) being stronger than the highest ranking baby jungle creature (i.e., lion). Again the instructions to the game will identify the relative ranking of the jungle creatures and the manner in which the additional member 28 affects that ranking.

The objects depicted on the playing pieces can be fictional fighting characters, such as children's plastic fighting men, which are ranked by strength. For example the following six fighting men, ranked from the strongest to the weakest, can be depicted: Keeper, Wolverine, Cyclops, Punisher, Colossus and Skeletor. In this version the additional member 28 either will specify "WARRIOR STATUS" or "WEAPON DYSFUNCTION", with the lowest ranking fighting man having warrior status being of a higher rank than the highest ranking fighting man with a weapon dysfunction. Again the instructions to the game will identify the relative ranking of the fighting men and the manner in which the additional member 28 affects that ranking.

The objects depicted on the playing pieces can be TV heroes, which are ranked by strength. For example the following six TV heroes, ranked from the strongest to the weakest, can be depicted: Superman, Batman, Tarzan, Zorro, Lone Ranger and Crocodile Dundee. In this version the additional member 28 either will specify "FULL POWERS" or "POWERS LOW", with the lowest ranking TV hero with full powers being of a higher rank than the highest ranking TV hero with his powers low. Again, the instructions to the game will identify the relative ranking of the TV heroes and the manner in which the additional member 28 affects that ranking.

It should be understood that other animate and inanimate objects can be included on the playing pieces, so long as the are rankable by some attribute, and wherein an additional factor can change the ranking.

Without further elaboration the foregoing will so illustrate my invention that others may, by applying current or future knowledge, adopt the same for use under various conditions of service.

I claim:

1. A game played without a game board, including a plurality of playing pieces; said game comprising:

A. a plurality of identical sets of playing pieces;

B. a means for ranking each of said playing pieces to enable playing pieces of higher ranking to capture playing pieces of lower ranking, and not controlling allowable movement of said pieces on a game board; said means for ranking comprising indicia representing animate or inanimate objects on said playing pieces; and C. each of said plurality of playing pieces including retaining means for retaining additional indicia indicating a specific condition of the object represented on said respective playing piece, which condition has a bearing on the order of ranking of the object.

2. The game of claim 1, wherein all of said objects on the plurality of playing pieces in each set are either animate objects or inanimate objects.

3. The game of claim 2, wherein the order of ranking the objects represented on the plurality of playing pieces in each set is on the basis of a common attribute.

4. The game of claim 3, wherein said additional indicia represents a condition affecting the common attribute, to thereby have a bearing on the order of ranking of each of said objects.

5. The game of claim 1, further including playing pieces having indicia representing a ranking higher than the ranking of any of the animate or inanimate objects.

6. The game of claim 1, wherein each of said plurality of sets of playing pieces includes an additional playing piece having indicia representing a ranking higher than the ranking of any of the animate or inanimate objects within each of said respective sets.

7. The game of claim 6, including at least four identical sets of playing pieces.

8. The game of claim 6, including six identical sets of playing pieces.

9. The game of claim 1, including at least four identical sets of playing pieces.

10. The game of claim 1, including six identical sets of playing pieces.

11. The game of claim 1, wherein said means for retaining additional indicia includes a compartment associated with each of said playing pieces, said additional indicia being present on an additional member, said additional member being removable receivable within said compartment, said additional indicia being concealed from view when said additional member is within said compartment.

12. The game of claim 1, wherein each of said plurality of playing pieces is a card-shaped piece.

13. The game of claim 12, wherein said means for retaining additional indicia includes a compartment forming part of said card-shaped piece, said additional indicia being present on an additional member, said additional member being removable receivable within said compartment, said additional indicia being concealed from view when said additional member is within said compartment.

14. The game of claim 12, wherein each of said card-shaped pieces includes a pair of substrates overlying each other and partially adhered to each other to form a compartment between said substrates, for retaining additional indicia, said pair of substrates providing an open region communicating with said compartment.

15. The game of claim 13, wherein each of said card-shaped pieces includes a pair of substrates overlying each other and partially adhered to each other to form the compartment between said substrates, said pair of substrates providing an open region communicating with said compartment, said open region providing access into said compartment for said additional member.

16. The game of claim 15, wherein all of said objects on the plurality of playing pieces in each set are either animate objects or inanimate objects.

17. The game of claim 1 wherein all of said objects are automobiles.

18. The game of claim 1 wherein all of said objects are fish.

19. The game of claim 1 wherein all of said objects are animals.

20. The game of claim 1 wherein all of said objects are dinosaurs.

21. The game of claim 1 wherein all of said objects are fictional characters.

22. The game of claim 1 wherein all of said objects are apes.

23. The game of claim 1 wherein all of said objects are jungle creatures.

24. The game of claim 1 wherein all of the objects are fictional fighting characters.

* * * * *